US009700194B2

(12) United States Patent
Han et al.

(10) Patent No.: US 9,700,194 B2
(45) Date of Patent: Jul. 11, 2017

(54) DISHWASHER

(71) Applicant: LG Electronics Inc., Seoul (KR)

(72) Inventors: Shinwoo Han, Seoul (KR); Daegyu Kim, Seoul (KR); Joonho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 177 days.

(21) Appl. No.: 13/865,291

(22) Filed: Apr. 18, 2013

(65) Prior Publication Data

US 2013/0276841 A1 Oct. 24, 2013

(30) Foreign Application Priority Data

Apr. 23, 2012 (KR) ..... 10-2012-0041971

(51) Int. Cl.

| | |
|---|---|
| ***A47L 15/23*** | (2006.01) |
| ***A47L 15/42*** | (2006.01) |
| ***A47L 15/50*** | (2006.01) |

(52) U.S. Cl.

CPC ..... *A47L 15/23* (2013.01); *A47L 15/4221* (2013.01); *A47L 15/508* (2013.01)

(58) Field of Classification Search

CPC ..... A47L 15/00; A47L 15/23; A47L 15/42; A47L 15/4221; A47L 15/02; B05B 15/10; B05B 3/02

See application file for complete search history.

(56) References Cited

U.S. PATENT DOCUMENTS

| | | | | |
|---|---|---|---|---|
| 3,160,164 | A * | 12/1964 | Constance et al. | 134/176 |
| 3,648,931 | A | 3/1972 | Jacobs | |
| 3,951,684 | A * | 4/1976 | LaPrad | A47L 15/23 134/144 |
| 4,174,723 | A | 11/1979 | Long | |
| 4,509,687 | A * | 4/1985 | Cushing | 239/245 |
| 5,427,129 | A * | 6/1995 | Young et al. | 134/176 |
| 5,697,392 | A | 12/1997 | Johnson | |
| 7,270,132 | B2 | 9/2007 | Inui | |
| 2006/0032536 | A1 * | 2/2006 | Galloway | F16K 37/0091 137/554 |

FOREIGN PATENT DOCUMENTS

| | | | |
|---|---|---|---|
| CN | 201039970 | Y | 3/2008 |
| CN | 201312794 | Y | 9/2009 |
| CN | 201470532 | U | 5/2010 |
| DE | 3816408 | A1 | 11/1989 |

(Continued)

OTHER PUBLICATIONS

Russian Decision on Grant dated Jul. 14, 2014 for Russian Application No. 2013116588, with English Translation, 16 pages.

(Continued)

*Primary Examiner* — Karla Moore
*Assistant Examiner* — Tinsae Ayalew
(74) *Attorney, Agent, or Firm* — Fish & Richardson P.C.

(57) ABSTRACT

The present disclosure relates to a dishwasher having a spray arm for spraying water to a lower rack and a tower nozzle for supplying water to an upper rack. The dishwasher may reduce (e.g., prevent) leakage of water from the tower nozzle, and may supply water to either the spray arm or to the tower nozzle through a rotating nozzle depending on a pressure of water.

18 Claims, 14 Drawing Sheets

(56) References Cited

FOREIGN PATENT DOCUMENTS

| | | | |
|---|---|---|---|
| EP | 1 264 570 | A1 | 12/2002 |
| EP | 1 731 081 | A2 | 12/2006 |
| JP | 2008-073131 | | 4/2008 |
| WO | WO 2008/072901 | A1 | 6/2008 |

OTHER PUBLICATIONS

Extended European Search Report issued in European Application No. 13164705.9 on Feb. 8, 2016, 8 pages.
Australian Office Action dated Nov. 28, 2014 for Australian Application No. 2013204523, 3 pages.
Chinese Office Action dated Mar. 25, 2015 for Chinese Application No. 201310139817.2, with English Translation, 13 pages.

* cited by examiner (a)

(b)

(a)

(b)

(a)

DISHWASHER

CROSS REFERENCE TO RELATED APPLICATION

Pursuant to 35 U.S.C. §119(a), this application claims the benefit of the Patent Korean Application No. 10-2012-0041971, filed on Apr. 23, 2012, which is hereby incorporated by reference as if fully set forth herein.

FIELD OF THE DISCLOSURE

The present disclosure relates to a dishwasher.

DISCUSSION OF THE RELATED ART

In general, the dishwasher is a machine for removing dirt from objects placed in a cleaning space by using water. The machine may also dry the objects.

FIG. 14 illustrates a related art dishwasher, provided with a cabinet 1 having a tub 11 for providing the cleaning space, an upper rack 21 and a lower rack 23 inside of the tub for holding the cleaning objects, a sump 13 under the tub 11 for holding the cleaning water, a lower arm 69 for spraying the cleaning water to the lower rack, an upper arm 68 for spraying the cleaning water to the upper rack, a pump P for supplying the cleaning water from the sump 13 to the lower arm 69 through a first flow passage P1, and a second flow passage P2 branched from the first flow passage for supplying the cleaning water to the upper arm 68.

The sump 13 has the cleaning water supplied to it through a water supply flow passage 131. The sump 13 drains the cleaning water through a drain water flow passage 133, and the second flow passage P2 receives the cleaning water introduced to the first flow passage P1 through a valve V and provides the cleaning water to the upper arm 68.

However, since the related art dishwasher can clean the cleaning objects held at the upper rack only when the upper arm 68 is positioned between the upper rack 21 and the lower rack 23, the related art dishwasher has a space for providing the upper arm 68 between the upper rack 21 and the lower rack 23.

Therefore, if the capacity of the tub 11 is limited, a height of each of the racks 21 and 23, and sizes of the cleaning objects to be placed in the racks 21 and 23 may be limited by the position of the upper arm 68.

Moreover, since the position of the second flow passage P2 may be inside a circumferential surface of the tub 11 for supplying the cleaning water to the upper arm 68, a length and a position of each of the racks 21 and 23 may be limited by the position of the second flow passage.

SUMMARY OF THE DISCLOSURE

An innovative aspect of the subject matter described in this disclosure may be embodied in a dishwasher that includes a tub that defines a cleaning space; a first rack positioned in the tub and configured to receive objects therein and a second rack provided under the first rack; a spray arm positioned under the second rack and configured to spray water; a tower nozzle fastened to the second rack and configured to spray water toward the first rack; a tower connector including an arm securing body that passes through the spray arm, and a tower body that is projected from the arm securing body and configured to supply water to the tower nozzle based on water being introduced to the arm securing body; a spray arm supporter including a supporter body configured to support the spray arm and having the arm securing body fastened thereto, a chamber in the supporter body that receives water, an arm supply hole in the chamber that supplies water to the spray arm, and a tower supply hole in the chamber that supplies water to the arm securing body; and a flow passage change over unit provided in the chamber and configured to open either the arm supply hole or the tower supply hole depending on a pressure of water in the chamber.

These and other embodiments can each optionally include one or more of the following features. The flow passage change over unit is configured to reciprocate and rotate toward the arm supply hole and the tower connector based on water being supplied to the chamber, and the flow passage change over unit is configured to reciprocate and rotate toward a direction of entry of water into the chamber based on water not being supplied to the chamber. The flow passage change over unit includes a cylindrical first body having an opened lower side, and a closed upper side with a tower opening hole provided therein that opens the tower supply hole; and a cylindrical second body that has an opened upper side and an opened lower side, and that houses the cylindrical first body. The cylindrical second body has a change over unit flange at an outside circumferential surface extended in a radial direction of the cylindrical second body, and an arm opening hole that passes through the change over unit flange and that is configured to open the arm supply hole.

The spray arm supporter includes a first gear provided to the chamber at a position between the arm supply hole and the tower supply hole; and a second gear provided to the chamber with the flow passage change over unit arranged between the first gear and the second gear. The flow passage change over unit includes a body rotating portion provided to have a cylindrical shape with an opened upper side and a lower side positioned between an outside circumference of the cylindrical first body and an inside circumference of the cylindrical second body, an upper gear provided to the body rotating portion to make the cylindrical first body and the cylindrical second body rotate based on the upper gear being engaged with the first gear, and a lower gear provided to the body rotating portion to make the cylindrical first body and the second body rotate based on the lower gear being engaged with the second gear.

The lower gear and the second gear make the cylindrical first body and the cylindrical second body rotate in a direction similar to a rotation direction of the cylindrical first body and the cylindrical second body based on the first gear and the upper gear being engaged. A center of the arm supply hole and a center of the tower supply hole are spaced a predetermined angle from each other with reference to a body rotation center, and a center of the arm opening hole and a center of the tower opening hole are provided on a straight line passing through a first body rotation center. The first gear and the upper gear are configured to rotate the flow passage change over unit by half of the predetermined angle of the center of the arm supply hole and the center of the tower supply hole, and the second gear and the lower gear are configured to rotate the flow passage change over unit by half of the predetermined angle of the center of the arm supply hole and the center of the tower supply hole.

The center of the arm supply hole and the center of the tower supply hole are spaced about 90 degrees, the first gear and the upper gear are configured to rotate the flow passage change over unit by about 45 degrees, and the second gear and the lower gear are configured to rotate the flow passage change over unit by about 45 degrees. The dishwasher further includes a rack fastening unit including a rack fastening body having a fastening body hole provided therein to be in communication with the tower nozzle; a coupling member configured to fasten the rack fastening body to the second rack; a partition wall provided to the fastening body hole; and a partition wall hole provided in the partition wall and configured to connect the tower body projected from the arm securing body to the partition wall. The tower body has a cylindrical shape with an opened lower side configured to receive water and a closed upper side.

The tower body includes a discharge hole passing through the closed upper side and configured to discharge water; an inner tube that projects from the closed upper side along an outside circumferential surface of the closed upper side and that inserts in the partition wall hole; and an outer tube that projects from the closed upper side and has a diameter larger than a diameter of the inner tube. The tower body further includes a sloped surface provided in a space between the inner tube and the outer tube, the sloped surface facing the inner tube, and a slit in the inner tube provided in a longitudinal direction of the inner tube and configured to connect a space between the inner tube and the outer tube with the discharge hole. The partition wall is provided in an elastic body. The partition wall is provided in a rigid body, and a leakage preventive tube is provided to an outside circumferential surface of the partition wall and inserts in the space between the inner tube and the outer tube.

The tower body further includes a flange projected from an outside circumferential surface of the tower body in a radial direction thereof, and the arm securing body includes a housing that is secured to the supporter body and that passes through the spray arm; a housing hole that passes through the housing and receives the flange; a guider provided to an inside circumferential surface of the housing hole and configured to prevent the flange from projecting past the housing hole; and a guider hole that passes through the guider and is configured to guide projection of the tower body from the housing. The tower body further includes guider projections that are provided to an outside circumferential surface of the tower body and that contact the guider hole. The tower body is attachable to and detachable from the tower connector.

It is to be understood that both the foregoing general description and the following detailed description of the present disclosure are exemplary and explanatory and are intended to provide further explanation of the technology as claimed.

BRIEF DESCRIPTION OF THE DRAWINGS

The accompanying drawings, which are included to provide a further understanding of the technology, illustrate examples of the technology and together with the description serve to explain the principle of the technology.

In the drawings.

DETAILED DESCRIPTION

Figure 1:
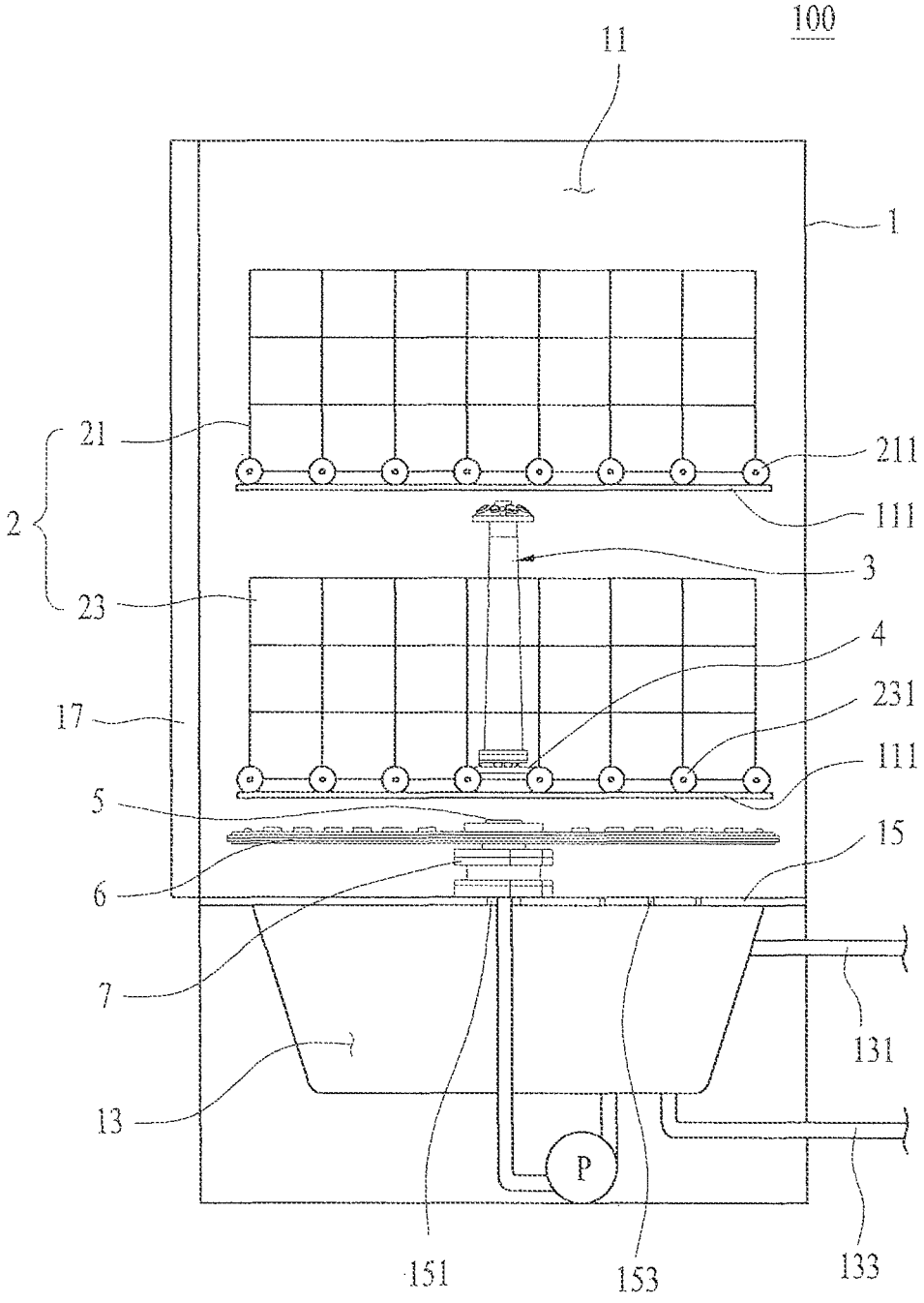
FIG. 1 illustrates a schematic view of an example dishwasher.

Referring to FIG. 1, an example dishwasher 100 includes a cabinet 1 which forms an exterior of the dishwasher 100, a tub 11 in the cabinet for providing a cleaning space, a sump 13 under the tub for holding cleaning water, a sump cover 15 on the sump for partitioning the tub 11 from the sump 13, and a door 17 provided to the cabinet for opening and closing the cleaning space.

Connected to the sump 13, there are a water supply flow passage 131 for supplying the cleaning water to the sump 13 and a drain flow passage 133 for draining the cleaning water from an inside of the sump. The sump cover 15 has a collection hole 153 for collecting the cleaning water sprayed to an inside of the cleaning space through the spray arm 6 to the sump.

There is a rack 2 in the tub 11 for placing objects, such as tableware. The rack 2 may include a first rack 21, and a second rack 23 positioned under the first rack, where, for the sake of convenience, the first rack 21 will be called as an upper rack, and the second rack 23 will be called as a lower rack.

The upper rack 21 and the lower rack 23 may be provided to be able to draw out of the tub 11 when the door 17 opens the cleaning space. For this, the tub has a rail 111 provided to an inside circumferential surface thereof directed toward the door 17, and each of the upper rack 21 and the lower rack 23 may further have wheels 211 and 231 for supporting the racks, respectively.

The dishwasher of the present disclosure includes a spray arm 6 provided in the tub 11 for cleaning the cleaning objects placed in the lower rack 23, a spray arm supporter 7 for supporting the spray arm 6 and having the cleaning water to be introduced thereto from the sump 13, a tower nozzle 3 fixedly secured to the lower rack and extended toward the upper rack 23, a tower connector 5 fixedly secured to the spray arm supporter 7 passing through the spray arm 6 so as to be detachable from and/or attachable to the tower nozzle 3, and a flow passage change over unit 8 provided in the spray arm supporter 7 for supplying the cleaning water introduced to the spray arm supporter 7 either to the spray arm 6 or to the tower connector 5.

Figure 2:
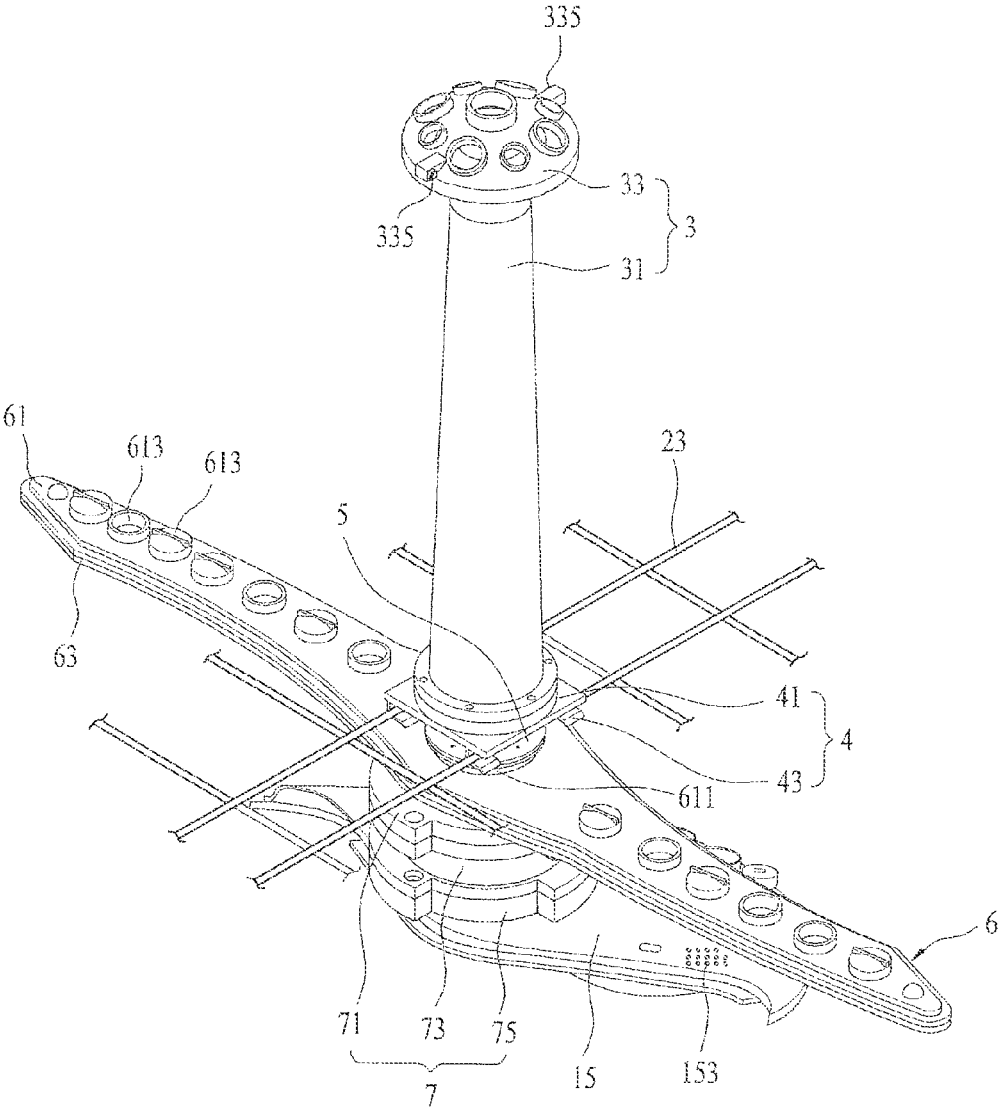
FIG. 2 illustrates a perspective view of an example tower nozzle and an example spray arm provided to a dishwasher.
Figure 3:
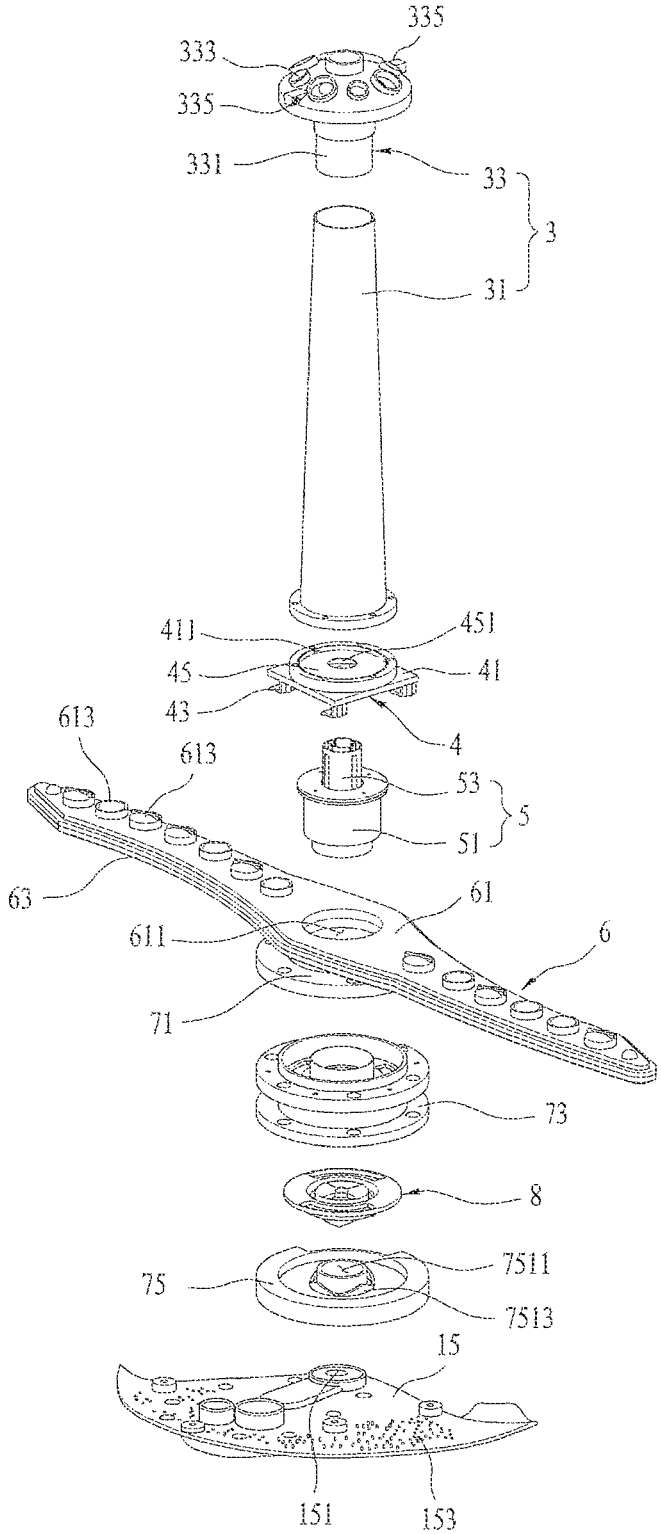
FIGS. 3, and 4 and 5 illustrate an exploded perspective view and assembled sections of an example tower nozzle, an example rack fastening unit, an example tower connector, an example spray arm, an example spray arm supporter, and an example flow change over unit provided to a dishwasher.

Referring to FIGS. 2 and 3, an example tower nozzle 3 may include a tower flow passage 31 that is a flow passage of the cleaning water, and an example spray nozzle 33 at a top of the tower flow passage 31 for spraying the cleaning water to the cleaning objects placed in the upper rack 21.

The tower flow passage 31 may have a cylindrical shape with opened upper side and lower side with a diameter that becomes smaller as the tower flow passage 31 goes from the lower side to the upper side for maintaining a constant flow rate even if the cleaning water is supplied to the lower side of the tower flow passage 31 through the tower connector 5 and moves toward the upper side of the tower flow passage 31.

Referring to FIG. 3, an example spray nozzle 33 positioned at the upper side of the tower flow passage 31 may include an insertion tube 331 to be inserted in the tower flow passage 31, and spray holes 333 for spraying the cleaning water introduced to the insertion tube.

The spray nozzle 33 may be provided to rotate because of the repelling force of the cleaning water being sprayed through the spray holes 333. For this, the spray nozzle 33 may be provided with supplementary spray holes 335 at opposite edges of the spray nozzle for spraying the cleaning water in directions different from each other.

Even though the tower flow passage 31 may be provided to be fixedly secured to the lower rack 23, as shown in FIG. 3, the tower flow passage 31 may be provided to be detachable from the lower rack 23 with a rack fastening unit 4.

The rack fastening unit 4 may include a rack fastening body 41 having the tower nozzle 3 coupled thereto, and a coupling member 43 for coupling the rack fastening body to the lower rack 23, and the rack fastening body 41 may have a fastening body pass through hole 411 provided to be in communication with the tower flow passage 31.

In this case, the fastening body attached to hole 411 may have a partition wall 45 provided thereto with a partition wall passing through hole 451. The hole 451 passes through the partition wall and is provided for placing a tower attachable/detachable body 53 therein.

The coupling member 43 may be provided in a variety of shapes. If the lower rack 23 is provided in a grating shape of wire (Steel wire or the like) as shown in FIG. 1, the coupling member 43 may be provided in a hook shape on a lower side of the rack fastening body 41 for holding the wire as shown in FIG. 3.

The partition wall 45 may be provided as an elastic or rigid body. According to definition at a dictionary, though the rigid body is a body of which deformation in a shape and a size can be neglected even if an external force is applied to the body, the rigid body described in the specification may include a body influence thereto of deformation in the shape and the size of the body can be neglected, even if the body deforms in the shape and the size upon application of the external force to the body.

Therefore, the partition wall 45 may be formed of rubber or a plastic.

The tower connector 5 includes an arm securing body 51 fixedly secured to the spray arm supporter 7 passed through the spray arm 6, and a tower attachable/detachable body 53 provided to be able to be projected from the arm securing body 51 so as to be connected to the partition wall pass through hole 451 when the cleaning water is introduced to the arm securing body 51.

Figure 4:
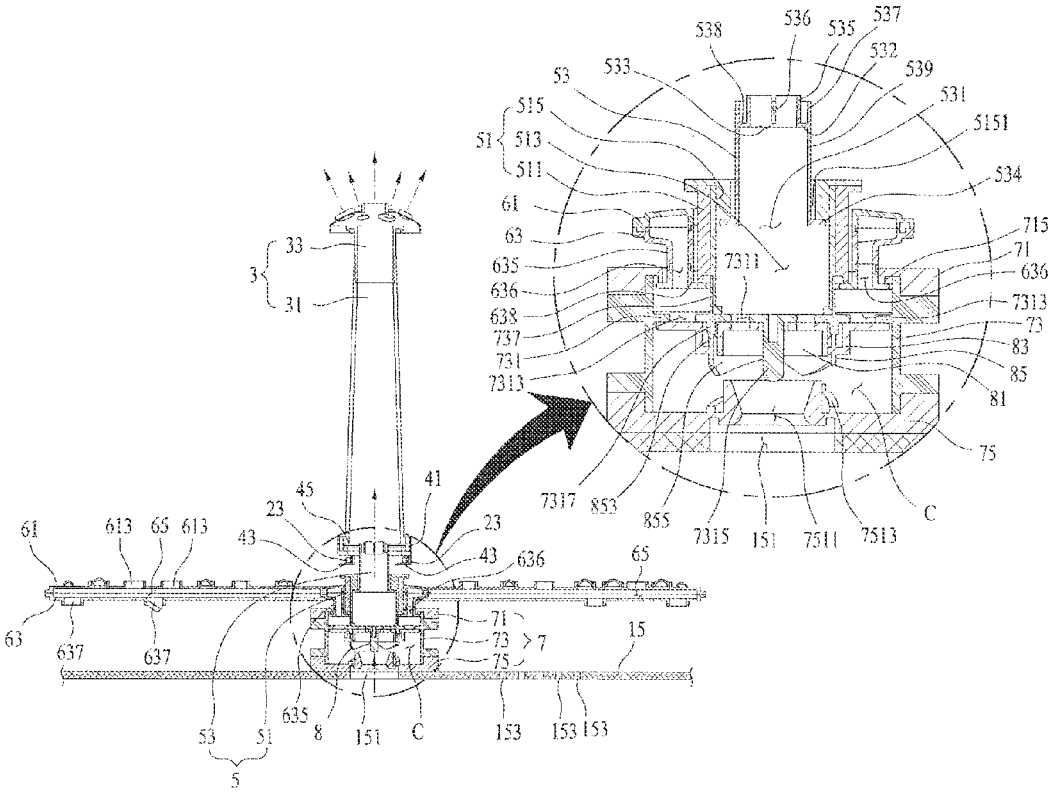
Figure 5:
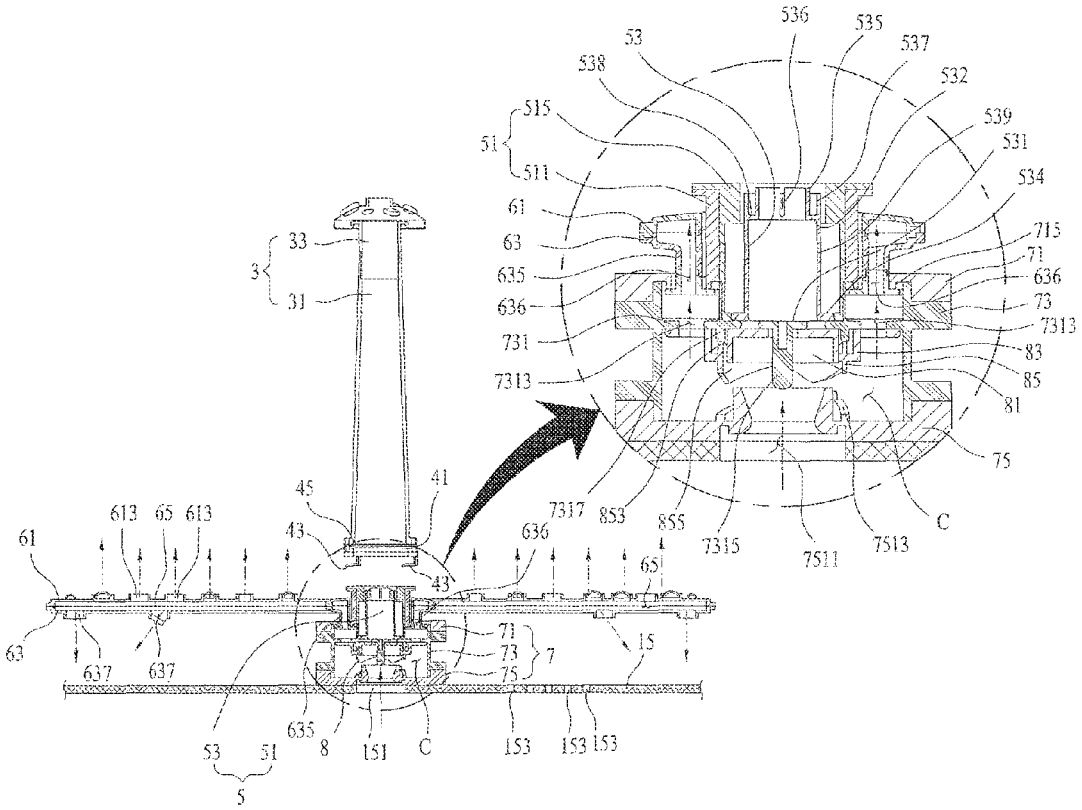

Referring to FIGS. 4 and 5, an example arm securing body 51 includes a cylindrical housing 511, a housing pass through hole 513 provided to pass through the housing, and a guider 515 having a guider pass through hole 5151 with a diameter smaller than the housing pass through hole 513.

The housing 511 has a lower side fixedly secured to the spray arm supporter 7 passing through the spray arm 511, and the tower attachable/detachable body 53 may be inserted through an opened lower side of the housing 511, and projected from the arm securing body 51 passed through the guider pass through hole 5151.

The guider pass through hole 5151 guides movement of the tower attachable/detachable body 53 when the tower attachable/detachable body 53 is being projected from the fastening body 51, and supporting an outside circumferential surface of the tower attachable/detachable body 53 projected from the arm securing body 51.

Figure 6:
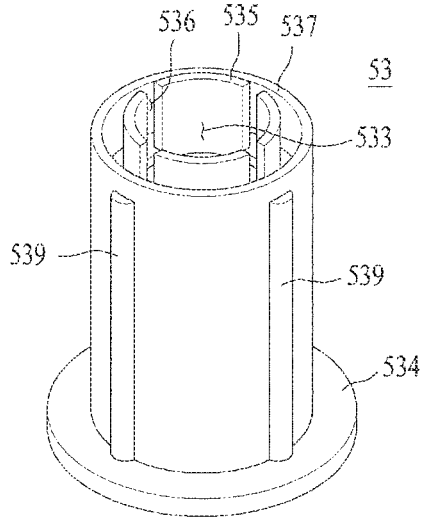
FIGS. 6A, 6B and 7 illustrate structures of an example tower connector provided to a dishwasher.
Figure 6:
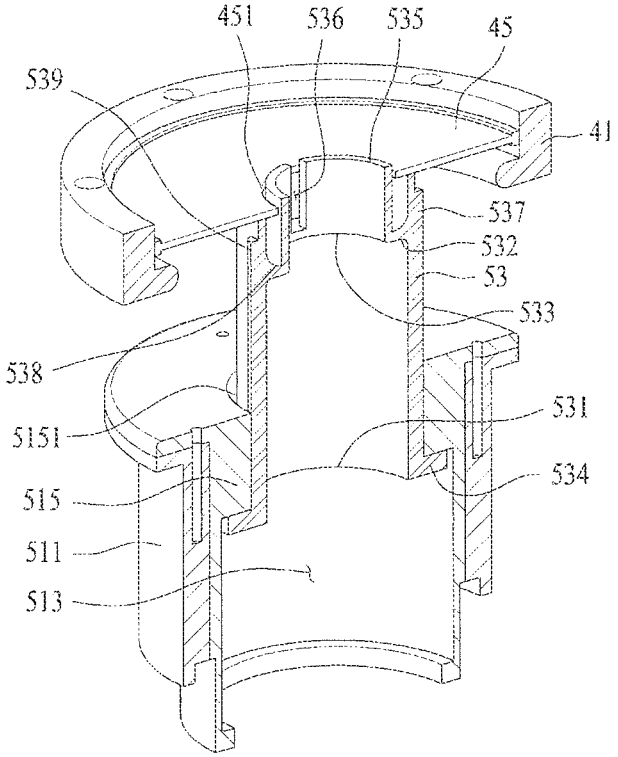

Referring to FIG. 6, an example tower attachable/detachable body 53 may have a cylindrical shape with an opened lower side 531 and a closed upper side 532. The upper side 532 may have a discharge hole 533 provided to pass through the upper side 532 for discharging the cleaning water introduced though the lower side 531 to an outside of the tower attachable/detachable body 53.

And, the tower attachable/detachable body 53 may include an inner tube 535 projected upward along an outside circumference of the discharge hole 533, and an outer tube 537 projected from the upper side 532 to have a diameter larger than a diameter of the inner tube.

If the cleaning water is introduced to an inside of the arm securing body 51 through the opened lower side of the housing 511, the tower attachable/detachable body 53 is projected from the arm securing body 51 through the guider pass through hole 5151, and the tower attachable/detachable body 53 projected from the arm securing body 51 thus has the inner tube 535 inserted in the partition wall pass through hole 451 to supply the cleaning water to the tower nozzle 3.

Since the diameter of the outer tube 537 is larger than the diameter of the inner tube 535, if the inner tube 535 is inserted in the partition wall pass through hole 451, bringing the outer tube 537 into contact with the partition wall 45 to surround the partition wall pass through hole 451, leakage of the cleaning water through a space between the partition wall pass through hole 451 and an outside circumferential surface of the inner tube 535 can be prevented.

Figure 7:
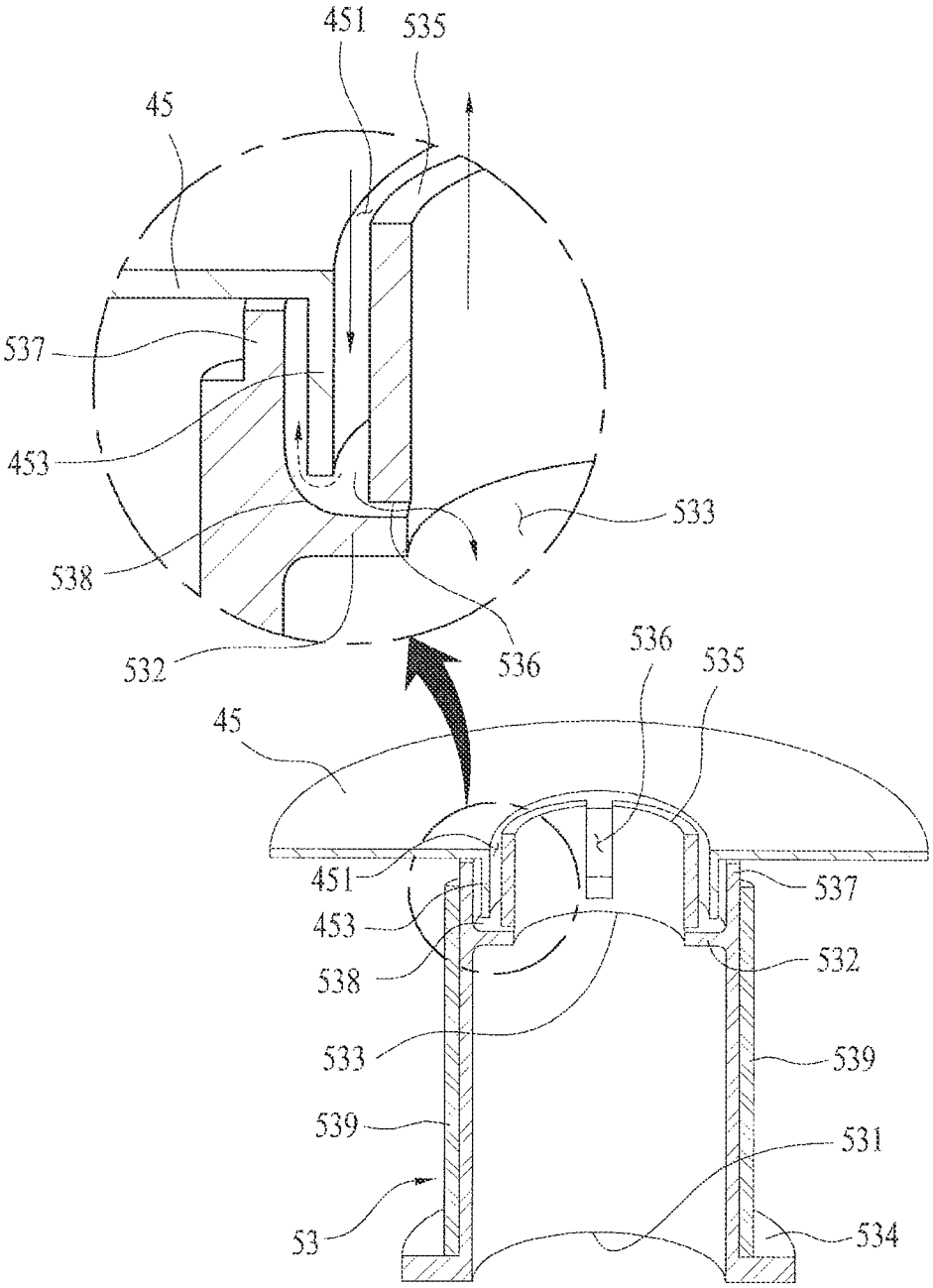

Referring to FIG. 7, an example sloped surface 538 is provided in a space between the inner tube 535 and the outer tube 537 to face the inner tube 535, and a slit 536 is provided in the inner tube 535 in a height direction of the inner tube for making a space formed between the inner tube 535 and the outer tube 537 to be in communication with the discharge hole 533.

This is provided for collecting the cleaning water to the discharge hole 533 through the sloped surface 438 and the slit 536, if the cleaning water leaks through the space between the partition wall pass through hole 451 and an outside circumferential surface of the inner tube 535.

Moreover, there may be a flange 534 projected from an outside circumference of a bottom of the tower attachable/detachable body 53 in a radial direction of the tower attachable/detachable body 53.

The flange 534 guides the tower attachable/detachable body 53 towards the guider pass through hole 5151 in contact with the housing pass through hole 513.

Moreover, the flange 534 prevents the tower attachable/detachable body 53 from separating from the housing 511 supported by the guider 515 in the inside circumferential surface of the housing pass through hole 513.

The tower attachable/detachable body 53 may have a plurality of guider projections 539 provided on an outside circumferential surface of the tower attachable/detachable body 53 in a height direction thereof additionally for preventing the tower attachable/detachable body 53 projected from the arm securing body 51 from shaking as the guider projections 539 are in contact with the guider pass through hole 5151.

As described before, the partition wall 45 of the rack fastening unit 4 may be formed of an elastic or rigid body.

When the tower attachable/detachable body 53 is projected from the arm securing body 51, the tower attachable/detachable body 53 is pressed toward the partition wall 45 by the cleaning water. If the partition wall 45 is formed of the elastic body, the leakage of the cleaning water moving from the tower flow passage 31 toward the tower attachable/detachable body 53 through the space between the partition wall pass through hole 451 and the inner tube 535 can be prevented only with the outer tube 537.

However, if the partition wall is formed of the rigid body, prevention of the leakage of the cleaning water moving from the tower flow passage 31 toward the tower attachable/detachable body 53 through the space between the partition wall pass through hole 451 and the inner tube 535 may be difficult only with the outer tube 537.

Accordingly, if the partition wall 45 is formed of the rigid body, it is a leakage preventive tube 453 may be provided on a lower side the partition wall pass through hole 451.

The leakage preventive tube 453 extends downward along an outside circumference of the partition wall pass through hole 451 so as to be inserted in the space between the inner tube 535 and the outer tube 537. Leakage of the cleaning water which moves toward the tower attachable/detachable body 53 from the tower flow passage 31 through the space between the outer tube 537 and the partition wall 45 can be minimized.

The spray arm supporter 7, not only supports the spray arm 6, but also has the tower connector 5 provided to pass through the spray arm to be fixedly secured thereto.

Referring to FIG. 4, an example spray arm supporter 7 has a supporter body 71, 72 and 73 having one end fixedly secured to the sump cover 15 and the other end connected to the spray arm 6. The supporter body 71, 72, and 73 has a chamber C contained therein for introducing the cleaning water.

The chamber C has an arm supply hole 7313 for supplying the cleaning water to the spray arm 6 and a tower supply hole 7311 for supplying the cleaning water to the tower connector 5.

Referring to FIG. 1, though the chamber C may have the cleaning water supplied thereto from the sump 13 by the pump P, the chamber C may have the cleaning water supplied thereto from the water supply source (not shown) positioned on an outside of the dishwasher, directly.

The dishwasher will be described with reference to a structure in which the cleaning water is supplied to the chamber C from the sump 13 by the pump P.

Figure 8:
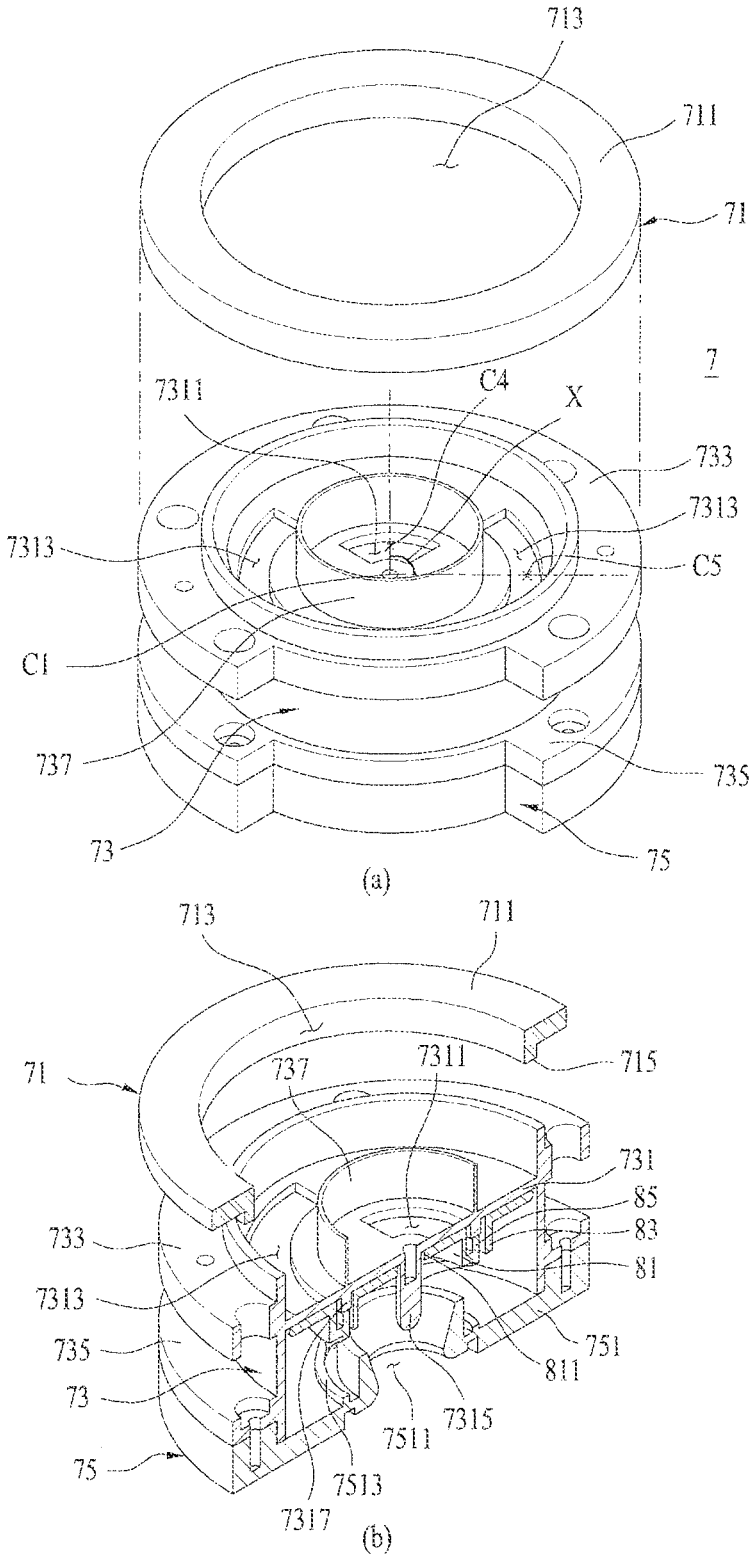
FIGS. 8A and 8B illustrate a perspective view and a perspective section of an example spray arm supporter provided to a dishwasher.

Referring to FIG. 8, an example supporter body may include a cylindrical main body 73 having opened upper side and lower side, an arm connection body 71 coupled to the upper side of the main body 73 for rotatably supporting the spray arm 6, and a cover securing body 75 provided to the lower side of the main body 73 for fixedly securing the main body 73 to the sump cover 15.

The main body 73 is provided with a body partition wall 731 for partitioning an inside space thereof, and the chamber C may be defined as a space constructed of the body partition wall 731 and the cover securing body 75.

Provided to the body partition wall 731, there are a tower supply hole 7311 and an arm supply hole 7313 on an outer side of the tower supply hole 7311, wherein the tower supply hole 7311 is in communication with the housing pass through hole 513 in the arm securing body 51, and the arm supply hole 7313 is in communication with an introduction flow passage 636 in the spray arm 6.

Provided on a lower side of the body partition wall 731, there are a change over unit guider 7315 and a first gear 7317.

The change over unit guider 7315 is inserted in a guider pass through hole 811 in the flow passage change over unit 8 for guiding the flow passage change over unit 8 to make a linear reciprocating movement within the chamber C.

The first gear 7317 is engaged with an upper gear 853 provided to a body rotating portion 85 of the flow passage change over unit 8 for rotating the flow passage change over unit 8 in one of a clockwise direction and a counter clockwise direction.

Provided on an upper side of the body partition wall 731, there is an arm securing body connection tube 737 to be connected to the housing pass through hole 513 of the arm securing body 51. The arm securing body connection tube 737 may be provided to surround the tower supply hole 7311, for enabling to supply the cleaning water being discharged from the chamber C through the tower supply hole 7311 only to the housing pass through hole 513.

The main body 73 may have an outside circumferential surface provided with a first fastening flange 733 having the arm connection body 71 fixedly secured thereto, and a second fastening flange 735 having the cover securing body 75 fixedly secured thereto.

The cover securing body 75 has one side fixedly secured to the second fastening flange 735 and the other side provided as a fastening body plate 751 fixedly secured to the sump cover 15.

The fastening body plate 751 has a plate pass through hole 7511 in communication with the supply hole 151 in the sump cover 15 for introduction of the cleaning water from the sump 13 to the chamber C through the plate pass through hole 7511.

That is, the pump P has one end connected to the sump 13, and the other end connected to the supply hole 151 in the sump cover for introduction of the cleaning water from the sump 13 to an inside of the chamber C through the supply hole 151 and the plate pass through hole 7511 by the pump P.

The cover securing body 75 has a second gear 7513 provided thereto further to be projected toward the body partition wall 731. The second gear 7513 is engaged with a lower gear 855 provided to the body rotating portion 85 of the flow passage change over unit 8 for rotating the flow passage change over unit 8.

The second gear 7513 may be provided along an outside circumferential surface of the plate pass through hole 7511.

The arm connection body 71 is fixedly secured to the main body 73 and rotatably supports the spray arm 6. The arm connection body 71 may include a connection body plate 711 fixedly secured to the first fastening flange 733, a connection tube pass through hole 713 provided to pass through the connection body plate to have a supporter connection tube 635 of the spray arm placed therein, and a connection tube supporting projection 715 extended from the connection tube pass through hole 713 toward the body partition wall 731 for supporting the supporter connection tube 635 of the spray arm 6.

Figure 9:
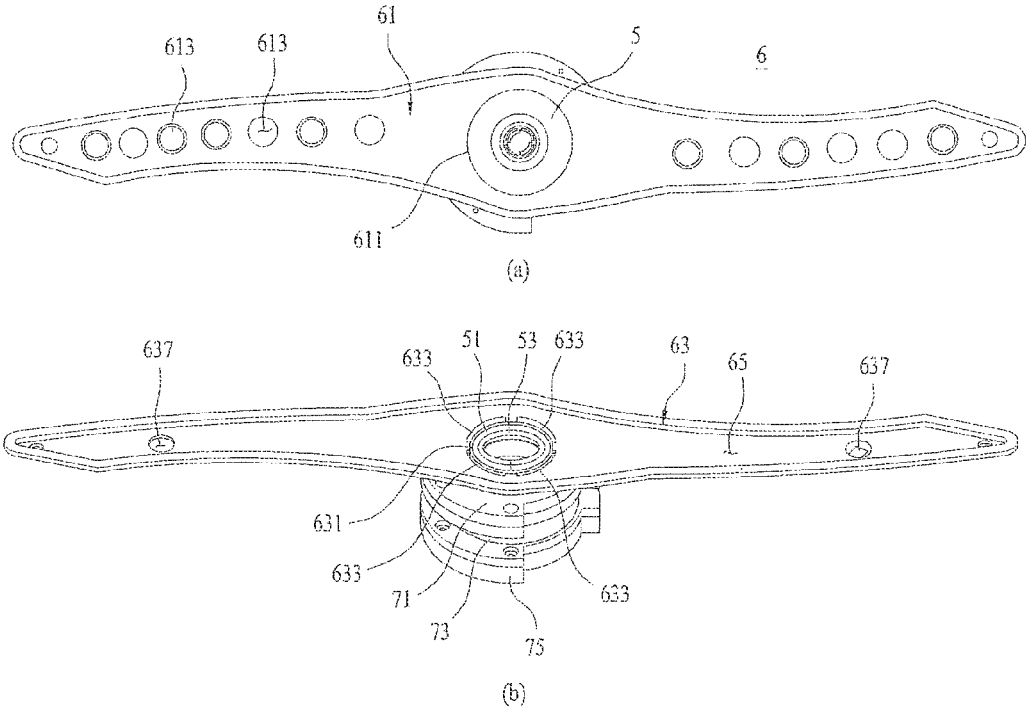
FIGS. 9A and 9B illustrate exploded perspective views of an example spray arm provided to a dishwasher

Referring to FIG. 9, an example spray arm 6 may include an upper frame 61 and a lower frame 63 both of which construe an arm flow passage 65.

The upper frame 61 and the lower frame 62 respectively have an upper frame pass through hole 611 and a lower frame pass through hole 631 through both of which the arm securing body 51 is passed.

And, the upper frame 61 has a plurality of upper spray holes 613 provided therein for spraying the cleaning water to the cleaning objects placed in the lower rack 23.

Some of the plurality of upper spray holes 613 may be provided to pass through the upper frame 61 for spraying the cleaning water in a vertical direction to the arm flow passage 65, and the rest are provided to spray the cleaning water slanted at a predetermined angle from a rotation plane of the spray arm 6.

This is for making the spray arm 6 to rotate because of the repelling force of the cleaning water being sprayed through the upper spray holes 613.

The lower frame 63 may include a plurality of lower spray holes 637 for spraying the cleaning water to a direction of the sump cover 15.

Since the spray arm 6 can rotate when the cleaning water is sprayed, if the cleaning water is sprayed in the direction of the sump cover 15, blocking of the collection hole 153 with the foreign matter can be prevented.

Figure 10:
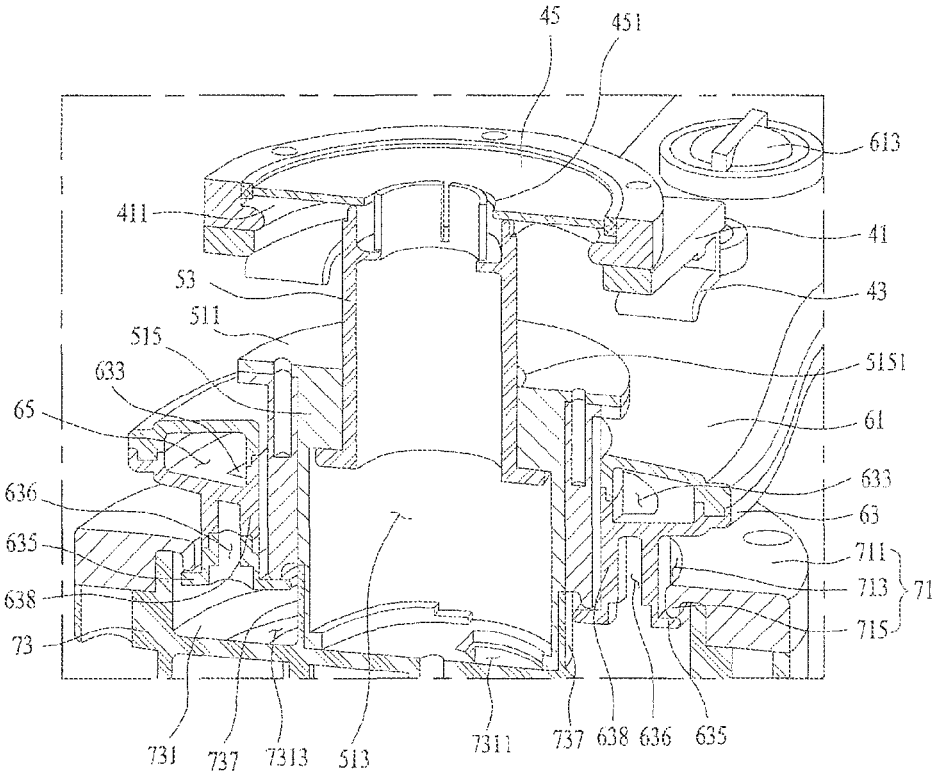
FIG. 10 illustrates a sectional perspective view of an assembly of an example spray arm, an example tower connector, and an example rack fastening unit.

Referring to FIG. 10, an example lower frame 63 has the supporter connection tube 635 provided thereto inserted in the connection tube pass through hole 713 of the arm connection body 71, wherein the supporter connection tube 635 has a housing receiving tube 638 on an inner side of the supporter connection tube 635 extended from the lower frame pass through hole 631.

The supporter connection tube 635 and the housing receiving tube 638 may be provided to have the same center with different diameters, to form an introduction flow passage 636 in communication with an introduction hole 633 formed on an outer side of the lower frame pass through hole 631. Therefore, the cleaning water discharged from the chamber C through the arm supply hole 7313 can be supplied to the arm flow passage 65 through the introduction flow passage 636 and the introduction hole 633.

Further provided to the chamber C, there is the flow passage change over unit 8 for opening either the tower supply hole 7311 or the arm supply hole 7313.

FIG. 11A illustrates an example upper side of the flow passage change over unit 8, and FIG. 11B illustrates an example lower side of the flow passage change over unit 8.

Referring to FIGS. 11A and 11B, the example flow passage change over unit 8 includes a cylindrical first body 81 having an opened lower side and a closed upper side, a cylindrical second body 83 having opened upper side and lower side, and a body rotating portion 85 positioned between the first body and the second body to be engaged with the first gear 7317 or the second gear 7513 depending on a water pressure in the chamber C.

The first body 81 has an upper side with a tower supply hole opening hole 813 for opening the tower supply hole 7311 in the body partition wall 731, and a guider pass through hole 811 for inserting the change over unit guider 7315 provided to the body partition wall 731 therein.

The second body 83 is provided with a change over unit flange 831 extended from an outside circumference of the second body in a direction moving away from a center of the second body, wherein the change over unit flange 831 may have a diameter provided the same with an inside diameter of the chamber C.

And, the change over unit flange 831 has an arm supply hole opening hole 833 for opening the arm supply hole 7313 provided in the body partition wall 731.

The body rotating portion 85, having a cylindrical shape with opened upper side and lower side, has the first body 81 and the second body 83 connected thereby, an upper side provided with an upper gear 853 to be engaged with the first gear 7317, and a lower side provided with a lower gear 855 to be engaged with the second gear 7513.

The upper gear 853 and the first gear 7317 may be provided to have shapes to be engaged with each other to turn the flow passage change over unit 8 by a predetermined angle in a clockwise or counter-clockwise direction, and the lower gear 855 and the second gear 7513 are provided to have shapes to be engaged with each other to turn the flow passage change over unit 8 by the predetermined angle in a direction the same with a rotation direction of the flow passage change over unit 8 when the upper gear and the first gear are engaged with each other.

A center C4 (See FIG. 8) of the tower supply hole 7311 provided to the body partition wall 731 and a center C5 of the arm supply hole 7313 may be spaced a predetermined angle X with reference to a rotation center C1 of the flow passage change over unit 8, and a center C2 (See FIG. 11) of the tow supply hole opening hole 813 and a center C3 of the arm supply hole opening hole 833 may be provided on a straight line which passes the rotation center C1 of the flow passage change over unit 8.

In this case, if the first gear 7317 and the upper gear 853 are engaged, the flow passage change over unit 8 may be provided to rotate by a half of the spaced angle X of the center C5 of the arm supply hole and the center C4 of the tower supply hole to open either the tower supply hole 7311 or the arm supply hole 7313, and if the second gear 7513 and the lower gear 855 are engaged, the flow passage change over unit 8 is provided to rotate by an half of the spaced angle X.

Figure 11:
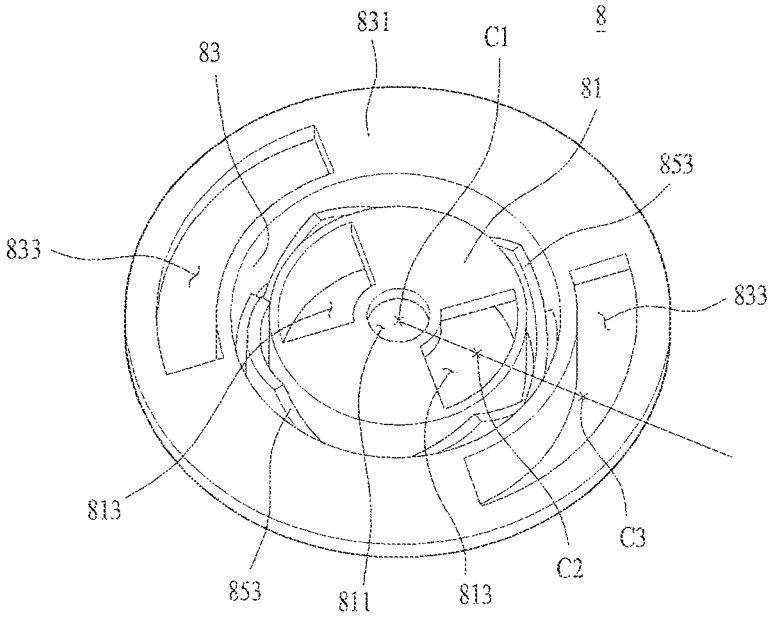
FIGS. 11A and 11B illustrate perspective views of an example flow change-over unit.
Figure 11:
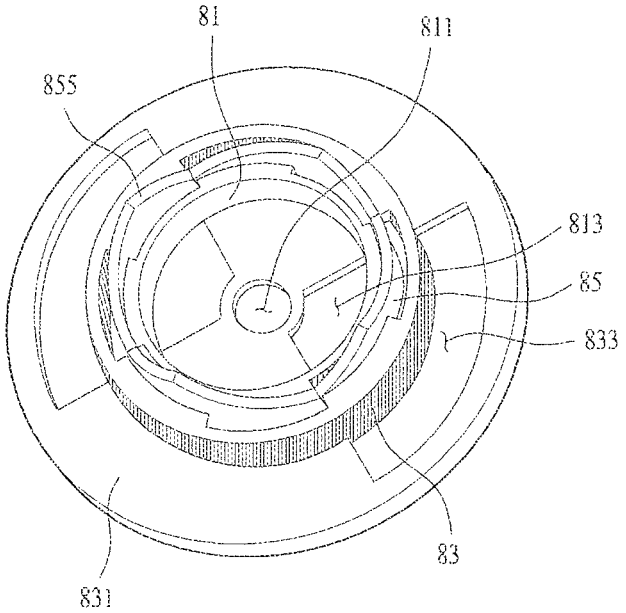

That is, if the center C4 of the tower supply hole 7311 and the center C5 of the arm supply hole are provided to be spaced by 90 degrees as shown in FIG. 8, and the center C2 of the tow supply hole opening hole 813 and the center C3 of the arm supply hole opening hole 833 are provided on a straight line which passes the rotation center C1 of the flow passage change over unit 8 as shown in FIG. 11, in a case the first gear 7317 and the upper gear 853 are engaged, or the second gear 7513 and the lower gear 855 are engaged, the flow change over unit 8 is provided to rotate in the same direction by 45 degrees.

The movement of the flow change over unit will be described with reference to FIGS. 12A-12D in more detail.

Figure 12:
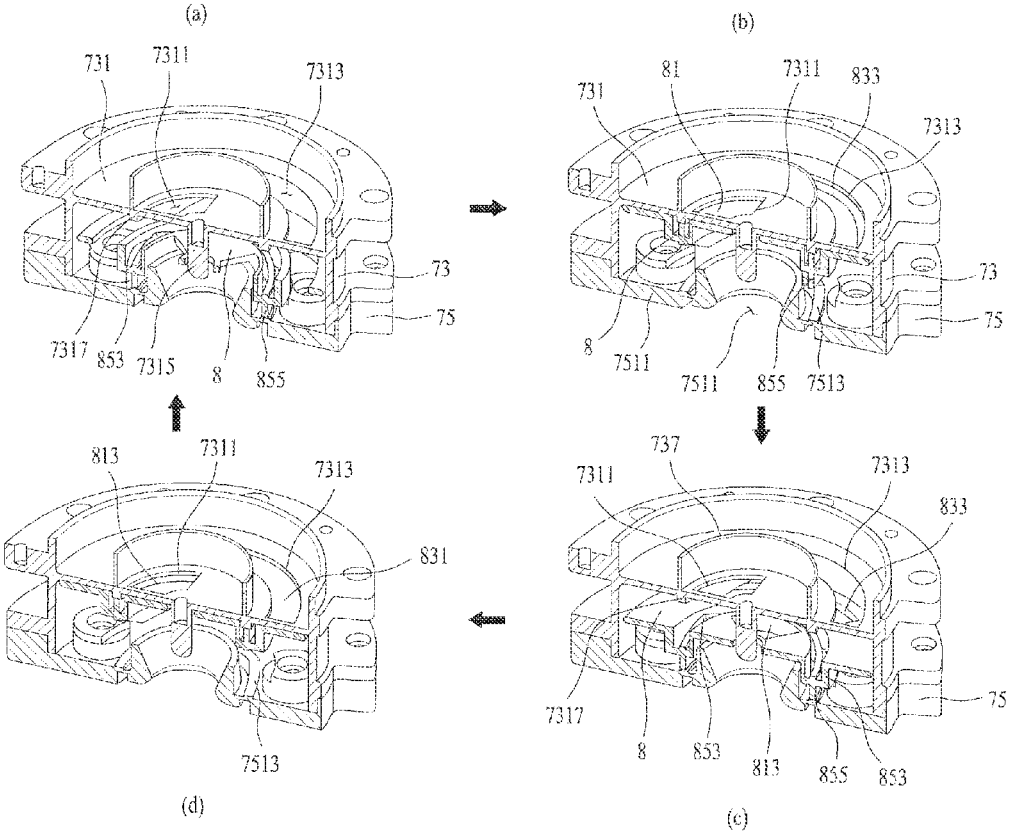
FIGS. 12A, 12B, 12C, and 12D illustrate sectional perspective views showing the steps of an example process for supplying cleaning water to a tower nozzle and a spray arm.

If the pump P is not in operation to supply no cleaning water to the chamber C, the flow passage change over unit 8 is in a state in which the flow passage change over unit 8 in contact with the cover securing body 75 (FIG. 12A).

In this case, if the pump P is put into operation to supply the cleaning water to the chamber C, the flow passage change over unit 8 moves toward the body partition wall 761 to make the upper gear 853 engage the first gear 7317 as shown in FIG. 12B.

Since the flow passage change over unit 8 turns by 45 degrees in the clockwise direction within the chamber C if the upper gear 853 and the first gear 7317 are engaged, then the arm supply hole opening hole 833 opens the arm supply hole 7313. However, the tower supply hole 7311 will be kept in a closed state by the first body 81.

Thereafter, if operation of the pump P stops temporarily, not to supply the cleaning water to the inside of the chamber C, the flow passage change over unit 8 moves toward the cover securing body 75.

If the flow passage change over unit 8 moves to the cover securing body 75, the lower gear 855 of the flow passage change over unit is engaged with the second gear 7513 (See FIG. 12C), turning the flow passage change over unit 8 by 45 degrees in the clockwise direction.

According to this, the center of the tower supply hole opening hole 813 is in a state spaced by 45 degrees from the center of the tower supply hole 7311, and the center of the arm supply hole opening hole 833 is in a state spaced by about 45 degrees from the center of the arm supply hole 7313.

If the pump P is put into operation to supply the cleaning water to the chamber C again, the flow passage change over unit 8 moves toward the body partition wall 761 to make the upper gear 853 of the flow passage change over unit to engage with the first gear 7317. According to this, the flow passage change over unit 8 turns about 45 degrees in the clockwise direction, making the tower supply hole opening hole 813 to open the tower supply hole 7311, and making the change over unit flange 831 to close the arm supply hole 7313 (FIG. 12D).

The dishwasher may have the center C4 of the tower supply hole 7311 and the center C5 of the arm supply hole 7313 be provided to a position on a straight line which passes the rotation center C1 of the flow passage change over unit 8, and the center C2 of the tower supply hole opening hole 813 and the center C3 of the arm supply hole opening hole 833 be provided to a position to be spaced a predetermined angle with reference to the rotation center C1 of the flow passage change over unit 8.

Figure 13:
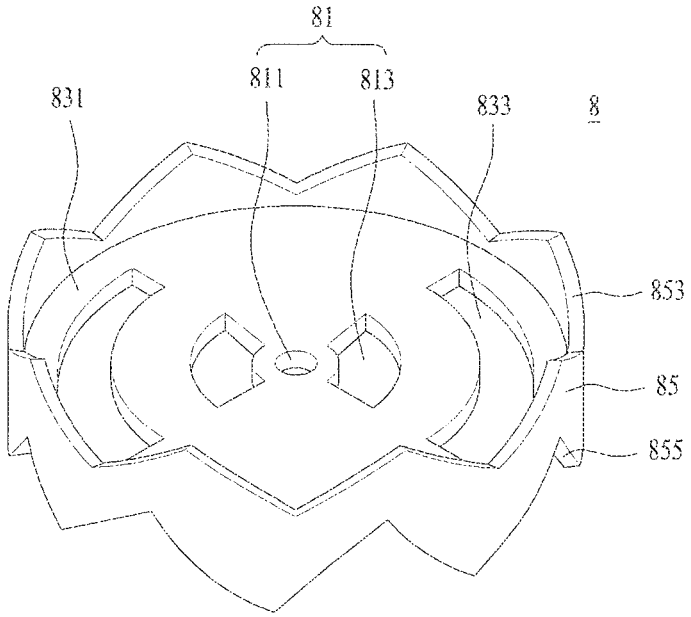
FIGS. 13A and 13B illustrate a perspective view and a section of an example flow passage change over unit provided to a dishwasher.
Figure 13:
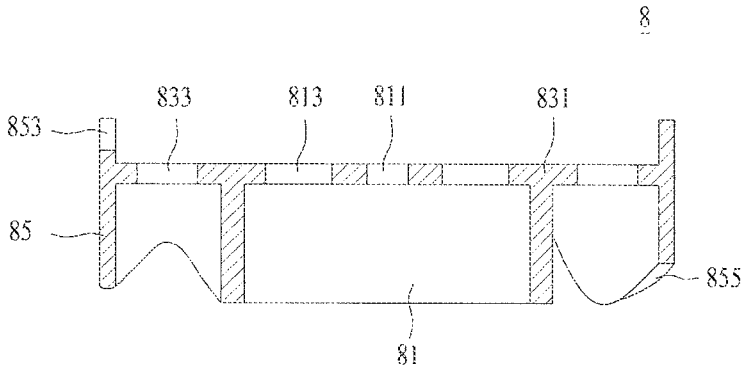
Figure 14:
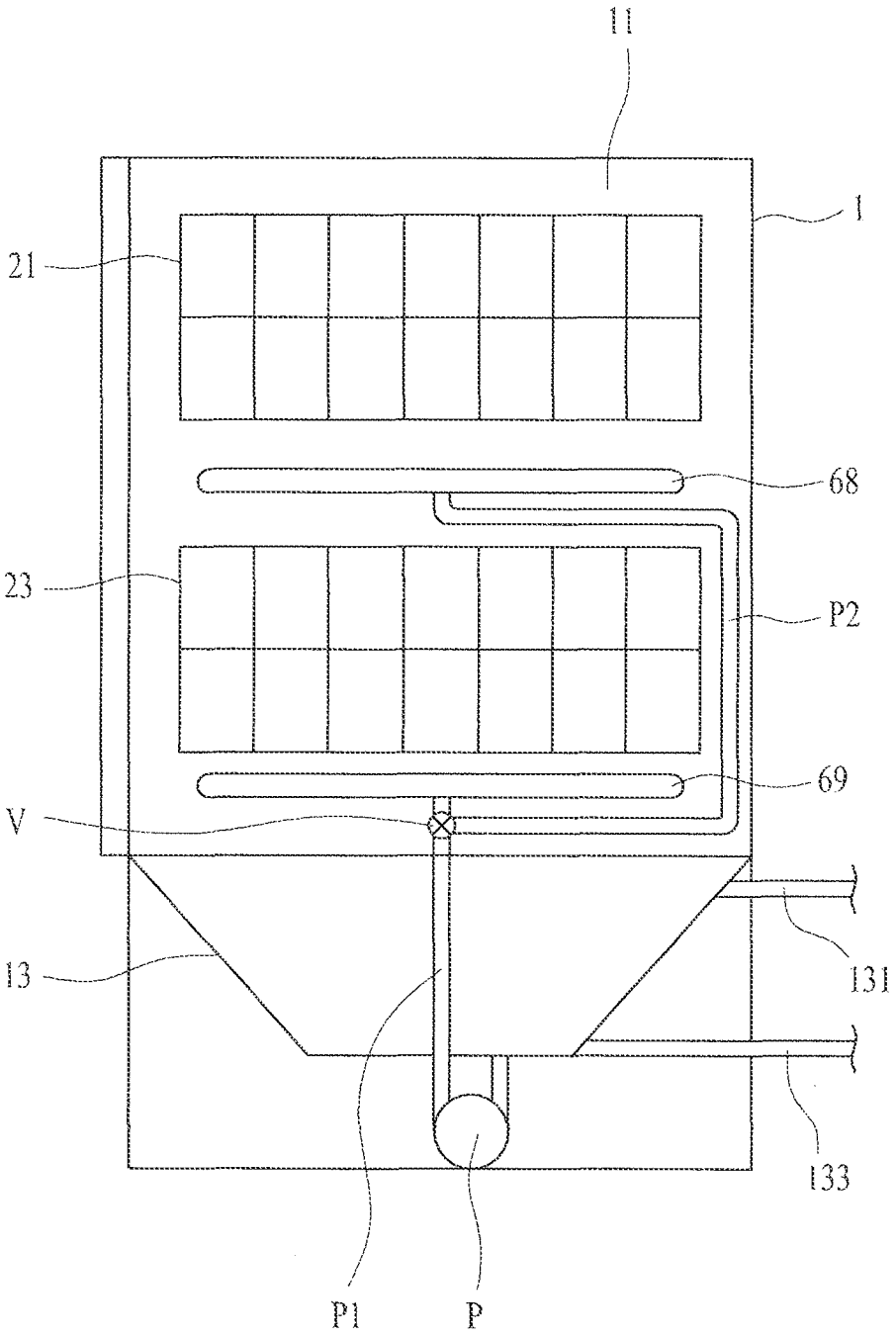
Fig. 14 PRIOR ART
FIG. 14 illustrates a schematic view of an example dishwasher in a related art.

FIGS. 13A and 13B illustrate a perspective view and a section of an example flow passage change over unit 8 provided to a dishwasher in accordance another example.

Though the example in FIGS. 11A and 11B is characterized in that the tower supply hole opening hole 813 is provided on the inner side of the body rotating portion 85, and the arm supply hole opening hole 833 is provided on the outer side of the body rotating portion 85, the present example is characterized in that both the tower supply hole opening hole 813 and the arm supply hole opening hole 833 are provided on the inner side of the body rotating portion 85.

That is, referring to FIGS. 13A and 13B, the example flow passage change over unit 8 includes a cylindrical first body 81 having an opened lower side, a change over unit flange 831 extended in a direction moving away from a rotation center of the first body in a radial direction of the first body 81, and a body rotating portion 85 provided along an outside circumference of the change over unit flange 831.

Provided to a closed upper side of the first body 81, there are a tower supply hole opening hole 813 for opening the tower supply hole 7311 in the body partition wall 731 and a guider pass through hole 811 for inserting the change over unit guider 7315 therein.

And, the change over unit flange 831 has an arm supply hole opening hole 833 provided therein for opening the arm supply hole 7313 provided in the body partition wall 731.

The body rotating portion 85 is provided to have a cylindrical shape with opened upper side and lower side, and an inside circumferential surface thereof coupled to the outside circumferential surface of the change over unit flange 831. In this case, The body rotating portion 85 may be provided to have an outside circumferential surface with a diameter that can be in contact with the inside circumferential surface of the chamber C.

And, the body rotating portion 85 has an upper side provided with an upper gear 853 and a lower side provided with a lower gear 855. In this case, the first gear 7317 may be provided to the body partition wall 731 and the second gear 7513 provided to the cover securing body 75 are provided at positions to be able to engage with the upper gear 853 and the lower gear 855 to rotate the flow passage change over unit 8, respectively.

The operation process of the dishwasher will be described with reference to the attached drawings.

The cleaning water is supplied from the sump 13 to the chamber C in the spray arm supporter 7 through the supply hole 151 in the sump cover 15 by the pump P shown in FIG. 1.

If the cleaning water is supplied to the chamber C, the flow passage change over unit 8 is moved toward the body partition wall 731 of the main body 73 as shown in FIG. 12B, making the upper gear 853 provided to the flow passage change over unit 8 to engage with the first gear 7317 provided to the body partition wall 731 to turn to the clockwise or counter-clockwise direction.

If the upper gear 853 engages with the first gear 7317 and turns to the clockwise direction, making the arm supply hole opening hole 833 in the flow passage change over unit 8 to open the arm supply hole 7313 in the body partition wall 731, then the cleaning water in the chamber C is supplied to the introduction flow passage 636 of the spray arm 6 as shown in FIG. 5.

The cleaning water introduced to the introduction flow passage 636 is supplied to the arm flow passage 65 through the introduction hole 633, and the cleaning water supplied to the arm flow passage 65 is sprayed to the lower rack 23 through the upper spray holes 613 in the spray arm 6, and is sprayed to the sump cover 15 through the lower spray holes 637.

If the cleaning water is sprayed through the upper spray holes 613, since the spray arm 6 rotates round the supporter connection tube 635, the cleaning water sprayed through the lower spray holes 637 can prevent the collection hole 153 in the sump cover 15 from blocking with the foreign matter.

In the meantime, if the operation of the pump P is stopped or the pressure of the cleaning water being supplied to the chamber C by the pump drops temporarily, the flow passage change over unit 8 positioned in the chamber C moves toward the cover securing body 75 of the spray arm supporter 7 as shown in FIG. 12C.

If the flow passage change over unit 8 moves to the cover securing body 75, since the lower gear 855 provided to the flow passage change over unit 8 engages with the second gear 7513 provided to the cover securing body 75, the flow passage change over unit 8 turns in the clockwise direction by a predetermined angle.

Then, if the pump P is put into operation again or if the pressure of the cleaning water being supplied to the chamber by the pump rises, the flow passage change over unit 8 moves toward the body partition wall 731 of the main body 73 again, making the upper gear 853 to engage with the first gear 7317 (See FIG. 12D).

If the upper gear 853 engages with the first gear 7317 thus, the flow passage change over unit 8 turns in the clockwise direction, making the tower supply hole opening hole 813 provided in the flow passage change over unit 8 to open the tower supply hole 7311 provided in the body partition wall 731. According to this, the cleaning water is supplied from the chamber C to the arm securing body 51 of the tower connector 5 as shown in FIG. 4.

Since the cleaning water supplied to the arm securing body 51 is introduced to the housing pass through hole 513, the tower attachable/detachable body 53 positioned in the housing pass through hole 513 is projected from the housing 511 through the guider pass through hole 5151.

The flange 534 and the upper side 532 provided to the tower attachable/detachable body 53 makes an upward moving motion of the tower attachable/detachable body 53 produced by the cleaning water introduced to the housing pass through hole 513 easier.

Since the tower attachable/detachable body 53 projected from the housing 511 rises toward the rack fastening unit 4, the inner tube 535 of the tower attachable/detachable body 53 is inserted in the partition wall pass through hole 451 in the rack fastening unit 4, and, if the inner tube 535 is inserted in the partition wall pass through hole 451, then the cleaning water being discharged from the discharge hole 533 in the tower attachable/detachable body 53 moves to the tower flow passage 31 in the tower nozzle 3.

Since the guider projections 539 are brought into contact with the guider pass through hole 5151 to secure a position of the tower attachable/detachable body 53 projected from the housing 511, coupling between the inner tube 535 and the partition wall pass through hole 451 is possible.

The cleaning water introduced to the tower flow passage 31 is sprayed to the upper rack 21 through the spray nozzle 33, to clean the cleaning object placed in the upper rack 21.

Referring to FIG. 6, if the inner tube 535 is inserted in the partition wall pass through hole 451, the outer tube 537 of the tower attachable/detachable body 53 surrounds the partition wall pass though hole 451, thereby enabling to prevent the cleaning water from leaking from an inside of the tower flow passage 31 to an outside of the tower flow passage 31.

Moreover, since the slit 536 is provided in the inner tube 535 at the upper side 532 of the tower attachable/detachable body 53 and the sloped surface 538 is provided in a space between the outer tube 537 and the inner tube 535 to face the slit 536, even if the cleaning water is discharged from the inside of the tower flow passage 31 through a space between the discharge hole 533 and the partition wall pass through hole 451, since the cleaning water discharged thus can be collected to the chamber C through the slit 536, leakage of the cleaning water from an inside of the tower flow passage 31 can be prevented.

Referring to FIG. 12A, if the operation of the pump P stops temporarily or if the pressure of the cleaning water being supplied to the chamber C by the pump P drops, the flow passage change over unit 8 positioned in the chamber C moves toward the cover securing body 75 in the spray arm supporter 7.

If the flow passage change over unit 8 moves to the cover securing body 75, the lower gear 855 provided to the flow passage change over unit 8 is engaged with the second gear 7513 provided to the cover securing body 75, and turns a predetermined angle in the clockwise direction, causing the tower attachable/detachable body 53 to move toward the body partition wall 731 and be separated from the partition pass through hole 451.

As has been described, the dishwasher of the present disclosure has the following advantages.

The disclosure may provide a dishwasher which, not only can enhance cleaning efficiency, but also enables effective utilization of a tub space cleaning objects are to be placed therein.

The disclosure may provide a dishwasher which has a spray arm for spraying cleaning water to a lower rack and a tower nozzle for supplying the cleaning water to an upper rack.

The disclosure may provide a dishwasher which supplies cleaning water to either a flow passage which supplies the cleaning water to spray arms or a flow passage which supplies the cleaning water to a tower nozzle through a flow passage change over unit which turns according to a cleaning water pressure.

The disclosure may provide a dishwasher which prevents the cleaning water supplied to a tower nozzle from leaking to an outside of the tower nozzle.

It will be apparent to those skilled in the art that various modifications and variations can be made in the present technology without departing from the spirit or scope of the technology. Thus, it is intended that the present technology cover the modifications and variations of this technology provided they come within the scope of the appended claims and their equivalents.

What is claimed is:

1. A dishwasher comprising:

a tub that defines a cleaning space;

a first rack positioned in the tub and configured to receive objects therein and a second rack provided under the first rack;

a spray arm positioned under the second rack and configured to spray water;

a tower nozzle fastened to the second rack and configured to spray water toward the first rack;

a tower connector including an arm securing body that passes through the spray arm, and a tower body that is projected from the arm securing body and configured to supply water to the tower nozzle based on water being introduced to the arm securing body;

a spray arm supporter including a supporter body configured to support the spray arm and having the arm securing body fastened thereto, a chamber in the supporter body that receives water, an arm supply hole in the chamber that supplies water to the spray arm, and a tower supply hole in the chamber that supplies water to the arm securing body;

a flow passage change over unit provided in the chamber and configured to open either the arm supply hole or the tower supply hole depending on a pressure of water in the chamber; and a rack fastening unit comprising:

a rack fastening body that defines a rack fastening body pass through hole that is configured to communicate with the tower nozzle;

a coupling member that is configured to connect the rack fastening body to the second rack; and a partition wall that is located in the rack fastening body pass through hole and that defines a partition wall pass through hole, wherein the rack fastening unit is configured to connect the tower body that is projected from the arm securing body to the partition wall, wherein the tower body has a cylindrical shape with an opened lower side configured to receive water and an upper side with a smaller diameter than the opened lower side, the upper side defining a discharge hole that is configured to discharge water, and wherein the tower body comprises:

an inner tube (i) that projects from the upper side along an outer circumferential surface of the discharge hole, (ii) that is configured to insert into the partition wall pass through hole and (iii) that defines a slit that is configured to collect water discharged from the tower flow passage, that is connected to the discharge hole such that the discharge hole receives the collected water, and that is parallel to the inner tube; and an outer tube that projects from the upper side and has a diameter that is larger than a diameter of the inner tube, wherein a leakage preventive tube is provided to an outside circumferential surface of the partition wall and inserts in the space between the inner tube and the outer tube.

2. The dishwasher as claimed in claim 1, wherein the flow passage change over unit is configured to rotate and move toward the arm supply hole and the tower connector based on water being supplied to the chamber, and the flow passage change over unit is configured to rotate and move toward a direction of entry of water into the chamber based on water not being supplied to the chamber.

3. The dishwasher as claimed in claim 2, wherein the flow passage change over unit comprises:

a cylindrical first body having an opened lower side, and a closed upper side with a tower opening hole provided therein that opens the tower supply hole; and a cylindrical second body that has an opened upper side and an opened lower side, and that houses the cylindrical first body, wherein the cylindrical second body has a change over unit flange at an outside circumferential surface extended in a radial direction of the cylindrical second body, and an arm opening hole that passes through the change over unit flange and that is configured to open the arm supply hole.

4. The dishwasher as claimed in claim 3, wherein the spray arm supporter comprises:

a first gear provided to the chamber at a position between the arm supply hole and the tower supply hole; and a second gear provided to the chamber with the flow passage change over unit arranged between the first gear and the second gear, wherein the flow passage change over unit includes a body rotating portion provided to have a cylindrical shape with an opened upper side and a lower side positioned between an outside circumference of the cylindrical first body and an inside circumference of the cylindrical second body, an upper gear provided to the body rotating portion to make the cylindrical first body and the cylindrical second body rotate based on the upper gear being engaged with the first gear, and a lower gear provided to the body rotating portion to make the cylindrical first body and the second body rotate based on the lower gear being engaged with the second gear.

5. The dishwasher as claimed in claim 4, wherein the lower gear and the second gear make the cylindrical first body and the cylindrical second body rotate in a direction similar to a rotation direction of the cylindrical first body and the cylindrical second body based on the first gear and the upper gear being engaged.

6. The dishwasher as claimed in claim 5, wherein a center of the arm supply hole and a center of the tower supply hole are spaced at a predetermined angle from each other with reference to a body rotation center, and a center of the arm opening hole and a center of the tower opening hole are provided on a straight line passing through a first body rotation center.

7. The dishwasher as claimed in claim 6, wherein the first gear and the upper gear are configured to rotate the flow passage change over unit by half of the predetermined angle of the center of the arm supply hole and the center of the tower supply hole, and the second gear and the lower gear are configured to rotate the flow passage change over unit by half of the predetermined angle of the center of the arm supply hole and the center of the tower supply hole.

8. The dishwasher as claimed in claim 6, wherein the center of the arm supply hole and the center of the tower supply hole are spaced 90 degrees, the first gear and the upper gear are configured to rotate the flow passage change over unit by 45 degrees, and the second gear and the lower gear are configured to rotate the flow passage change over unit by 45 degrees.

9. The dishwasher as claimed in claim 1, wherein the tower body further comprises:

a sloped surface provided in a space between the inner tube and the outer tube, the sloped surface facing the inner tube.

10. The dishwasher as claimed in claim 9, wherein the partition wall is provided in an elastic body.

11. The dishwasher as claimed in claim 9, wherein the partition wall is provided in a rigid body.

12. The dishwasher as claimed in claim 1, wherein the tower body further includes a flange projected from an outside circumferential surface of the tower body in a radial direction thereof, and the arm securing body comprises:

a housing that is secured to the supporter body and that passes through the spray arm;

a housing hole that passes through the housing and receives the flange;

a guider provided to an inside circumferential surface of the housing hole and configured to prevent the flange from projecting past the housing hole; and a guider hole that passes through the guider and is configured to guide projection of the tower body from the housing.

13. The dishwasher as claimed in claim 12, wherein the tower body further includes guider projections that are provided to an outside circumferential surface of the tower body and that contact the guider hole.

14. The dishwasher as claimed in claim 1, wherein the tower body is attachable to and detachable from the tower connector.

15. The dishwasher as claimed in claim 1, wherein the tower connector includes a tower attachable/detachable body that is separate from the spray arm and that is configured to provide water from the spray arm to the tower nozzle.

16. The dishwasher as claimed in claim 15, wherein the tower attachable/detachable body is configured to extend from the spray arm based on water pressure in the spray arm being above a water pressure threshold.

17. The dishwasher as claimed in claim 15, wherein the tower attachable/detachable body is configured to be recessed into the arm securing body based on water pressure in the spray arm being below a water pressure threshold.

18. The dishwasher as claimed in claim 15, wherein the tower attachable/detachable body is configured to engage the tower nozzle based on water pressure in the spray arm being above a water pressure threshold.

* * * * *